US005335847A

United States Patent [19]

Lisiecki

[11] Patent Number: 5,335,847

[45] Date of Patent: Aug. 9, 1994

[54] FLAT TOP CONTAINER AND BLANK FOR CONSTRUCTING SAME

[75] Inventor: Robert E. Lisiecki, Stanwood, Mich.

[73] Assignee: Elopak Systems A.G., Glattbrugg, Switzerland

[21] Appl. No.: 975,674

[22] Filed: Nov. 13, 1992

Related U.S. Application Data

[63] Continuation of Ser. No. 822,861, Jan. 21, 1992, abandoned.

[51] Int. Cl.[5] ..... B63D 17/32

[52] U.S. Cl. ..... 229/244; 229/133; 229/137; 229/223

[58] Field of Search ..... 229/132, 138, 221, 223, 229/137, 243, 244, 133

[56] References Cited

U.S. PATENT DOCUMENTS

| | | | |
|---|---|---|---|
| 2,124,868 | 7/1938 | Davidson | 229/208 |
| 2,368,534 | 1/1945 | Forrer | 229/223 X |
| 3,661,321 | 5/1972 | Tessmer, Jr. | 229/137 X |
| 3,662,945 | 5/1972 | Foster et al. | 229/223 |
| 3,958,748 | 5/1976 | Smith et al. | 229/222 X |
| 4,294,403 | 6/1978 | Takefman et al. | 229/138 X |
| 4,397,415 | 8/1983 | Lisiecki | 229/223 |
| 4,702,407 | 10/1987 | Lisiecki | 229/132 X |
| 4,784,272 | 11/1988 | Lisiecki et al. | 229/223 X |
| 4,911,305 | 3/1990 | Chung et al. | 229/221 |

*Primary Examiner*—Allan N. Shoap
*Assistant Examiner*—Christopher McDonald
*Attorney, Agent, or Firm*—Reising, Ethington, Barnard, Perry & Milton

[57] ABSTRACT

A flat top thermoplastic coated container and blank including side edge panels, a front edge panel adaptable to being folded back onto itself and having an arcuate-shaped perforated line formed thereon, and a cover panel. The perforated line breaks upon the cover panel being opened to form a horizontal, arcuate-shaped pouring edge. The side edge panels are wider adjacent the cover panel than adjacent the front edge panel to effectively control film delamination upon the cover panel being opened and prevent seepage or "wicking" at the side seam upper edge.

8 Claims, 4 Drawing Sheets

FLAT TOP CONTAINER AND BLANK FOR CONSTRUCTING SAME

This is a continuation of application Ser. No. 822,861, filed on Jan. 21, 1992, now abandoned.

TECHNICAL FIELD

This invention relates generally to thermoplastic coated paperboard containers and, more particularly, to a blank and a container including a top end closure of an improved construction.

BACKGROUND ART

Containers for beverages such as milk, cream, other dairy products, juices, and the like, are conventionally constructed from thermoplastic coated paperboard. Typically, these containers include a top end closure with a folded roof structure adaptable to providing a readily available pouring spout when the contents of the container are to be dispensed.

Coated paperboard blanks for constructing such a container are made on converting machines similar to those disclosed by Monroe et al U.S. Pat. No. 2,672,208 and Earp U.S. Pat. No. 3,731,600. After construction, the blanks are processed by forming, filling and sealing machines, such as those disclosed by Monroe et al U.S. Pat. No. 3,303,761, Allen U.S. Pat. No. 3,918,236, Egleston U.S. Pat. No. 3,398,659 or Young U.S. Pat. No. 4,193,833, to produce the formed, filled and sealed containers of the type referred to above and shown and described in Egleston et al U.S. Pat. No. 3,270,940 or Lisiecki U.S. Pat. No. 4,422,570.

Other flat top container arrangements, which do not include a pouring spout as in Pat. Nos. 3,270,940 and 4,422,570, are disclosed in Lisiecki Pat. Nos. 4,397,415, 4,702,407, and 4,784,272. These three patents disclose cartons which are adaptable to holding frozen juices or "spoonable" products, and having their top closures fully opened to provide access to the contents.

U.S. Pat. Nos. 4,702,407 and 4,784,272 are formed, respectively, to include perforations on the front panel adjacent the top end portion thereof, and along the score line between the front panel and the adjacent flat top panel.

U.S. Pat. No. 4,397,415 discloses a perforated line or partial cut formed horizontally across the fold line between a front fold-in panel segment and a fold-out segment. Accordingly, when the top is opened by breaking the perforated line or partial cut, and lifting the cover panel, a horizontal front edge panel remains, as well as a pair of oppositely disposed side fold-in edge panels, each bearing paper tear surfaces.

DISCLOSURE OF THE INVENTION

A general object of the invention is to provide a thermoplastic coated paperboard container including an improved top closure arrangement.

Another object of the invention is to provide an improved flat top container which is conveniently openable and readily pourable.

A further object of the invention is to provide a flat top container wherein a horizontally oriented, arcuate-shaped pouring lip is formed on a front fold-in panel segment when the flat top end closure is opened.

A still further object of the invention is to provide a flat top container including side edge panels wherein the portions adjacent the full cover panel are wider than the portions adjacent the front edge panel to effectively control film delamination when the top cover is being opened.

Other objects and advantages of the invention will become more apparent when reference is made to the following drawings and related description.

BEST MODE OF CARRYING OUT THE INVENTION

Figure 1:
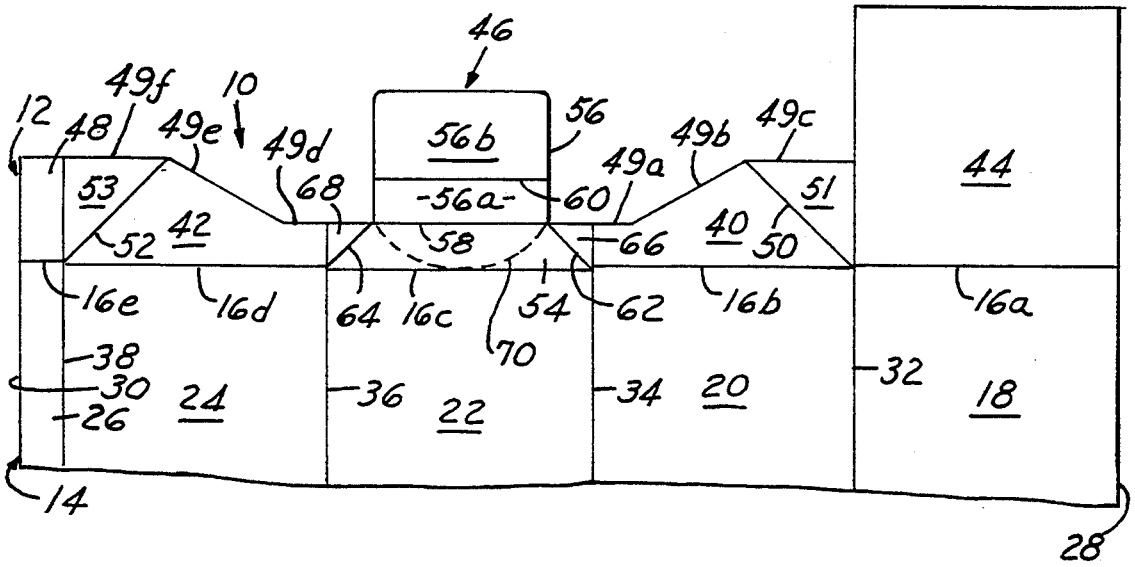
FIG. 1 is a fragmentary layout view of the inside surface of a coated paperboard container blank used to construct a container having a top end closure in accordance with the present invention.

Referring now to the drawings in greater detail, FIG. 1 illustrates a container blank 10 formed in accordance with the principles of the present invention. The container blank 10 is generally divided into three sections including a top end closure 12, a body portion 14, and a conventional flat bottom end closure (not shown). The latter may be any suitable end closure arrangement and is not a part of this invention.

More specifically, horizontal score lines **16*a*, 16*b*, 16*c*, 16*d* and 16*e* extend transversely across the container blank 10 and separate the top end closure 12 and the body portion 14. Likewise, bottom horizontal score lines (not shown) extend transversely across the container blank 10 and separate the bottom end closure (not shown) and the body portion 14**.

The body portion 14 comprises a plurality of integrally connected body panels, namely, in FIG. 1 from right to left, a back panel 18, a side panel 20, a front panel 22 and a side panel 24, and a side seam flap or narrow fifth panel 26 formed adjacent the panel 24. The container blank 10 is defined on its longitudinal sides by edges 28 and 30. The body panels 18, 20, 22 and 24, and the side seam flap 26, are defined by vertical score lines 32, 34, 36 and 38. It should be apparent that the body panels may be equal in width and hence, adaptable to forming a square cross-section container, or may be formed such that one pair of alternate body panels is wider than the other pair and, hence, adaptable to forming a rectangular cross-section container.

The top end closure 12 comprises side fold-in edge panels 40 and 42. The panels 40 and 42 are connected integrally to the upper ends of the body panel members 20 and 24, respectively. A cover panel 44 and a front edge panel 46 are connected integrally to the body panels 18 and 22, respectively. A further panel 48 is connected integrally to the upper end of the side seam flap 26. A free cut edge consists of a narrow horizontal portion **49*a*, a sloped portion 49*b*, and a wide horizontal portion 49*c*. A diagonal score line 50 extends from the approximate juncture of the score lines 16b and 32 to the juncture of the free cut edges 49b and 49c of the panel 40 and the panel 51, respectively, forming a triangular fold-over panel segment 51. A free cut edge consists of a narrow horizontal portion 49d, a sloped portion 49e, and a wide horizontal portion 49f. A diagonal score line 52 extends from the approximate juncture of the score lines 16d and 38 to the juncture of the free cut edges 49e and 49f of the panel 42 and the panel 53, respectively, forming a triangular foldover panel segment 53**.

The front edge panel 46 includes a fold-in segment 54 connected to the body panel 22 and a narrower segment 56 extending from the panel segment 54, with a score line 58, formed therebetween. A horizontal score line 60 is formed across the panel segment 56 at a distance from the perforations 58 approximately equal to the height of the panel segment 54, separating the segment 56 into a fold-out portion 56a and a fold-over portion 56b, the latter to become a lift tab, as will be explained. Oppositely disposed diagonal score lines 62 and 64 are formed on the panel segment 54. The diagonal score line 62 extends from the approximate juncture of the score lines 16c and 34 to the right hand (FIG. 1) juncture of the free cut edges of the panel segment 54 and the portion 56a, producing a triangular fold-over panel portion 66. The diagonal score line 64 extends from the approximate juncture of the score lines 16c and 36 to the left hand juncture of the free cut edges of the panel segment 54 and the portion 56a, producing a triangular fold-over panel portion 68.

A substantially arcuate-shaped perforated line 70 is formed in the panel segment 54 arcing from the juncture of the free cut edges of the panel segment 54 and the portion 56a on the right, to the juncture of the free cut edges of the panel segment 54 and the portion 56a on the left, and approximately tangent to the midpoint of the score line 16c.

Figure 2:
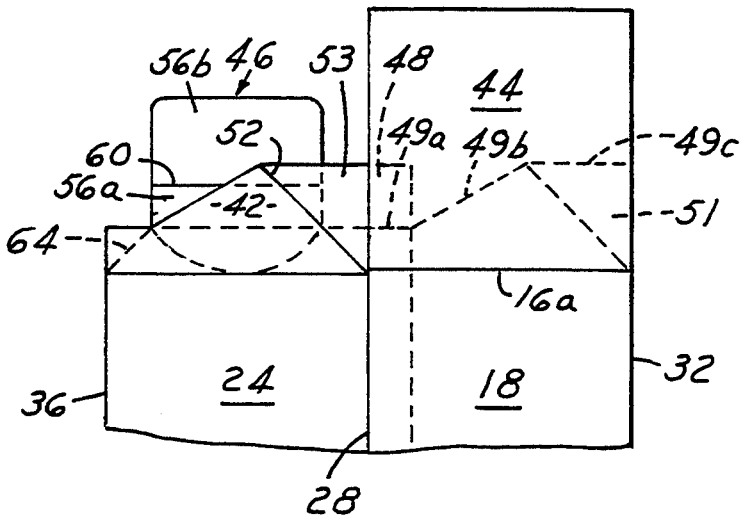
FIG. 2 is a fragmentary layout view of the outside surface of a blank after it is side seamed from the blank illustrated in FIG. 1.

The container blank 10 illustrated in FIG. 1 is first formed into the side seamed blank in FIG. 2 in the customary manner by rotating the body panel 24 and the side seam flap 26 as a unit about the vertical score line 36, and having the inside surfaces of the body panel 24 come into contact with the inside surface of the body panel 22, with the vertical score line 38 positioned next to the vertical score line 34, and with the inside surface of the side seam flap 26 contacting the inside surface of the body panel 20 adjacent the vertical score line 34. The body panel 18 is then rotated about the vertical score line 32 to bring its inside surface into contact with the inside surface of the body panel 20. The inside surface of the body panel 18 along the edge 28 comes into contact with the outside surface of the side seam flap 26, and the edge 28 is positioned parallel and approximately aligned with the vertical score line 38. The various members of the top end closure 12 and the bottom end closure will make similar movements. The container blank 10 is then sealed where the inside area of the body panel 18 comes into contact with the outside surface of the side seam flap 26.

In the FIG. 1 structure, if desired, in the formation of the side seam blank the side seam panel 26 could be sealed to the outside surface of the adjacent back panel 18, rather than to the inner surface thereof as described above.

Figure 3:
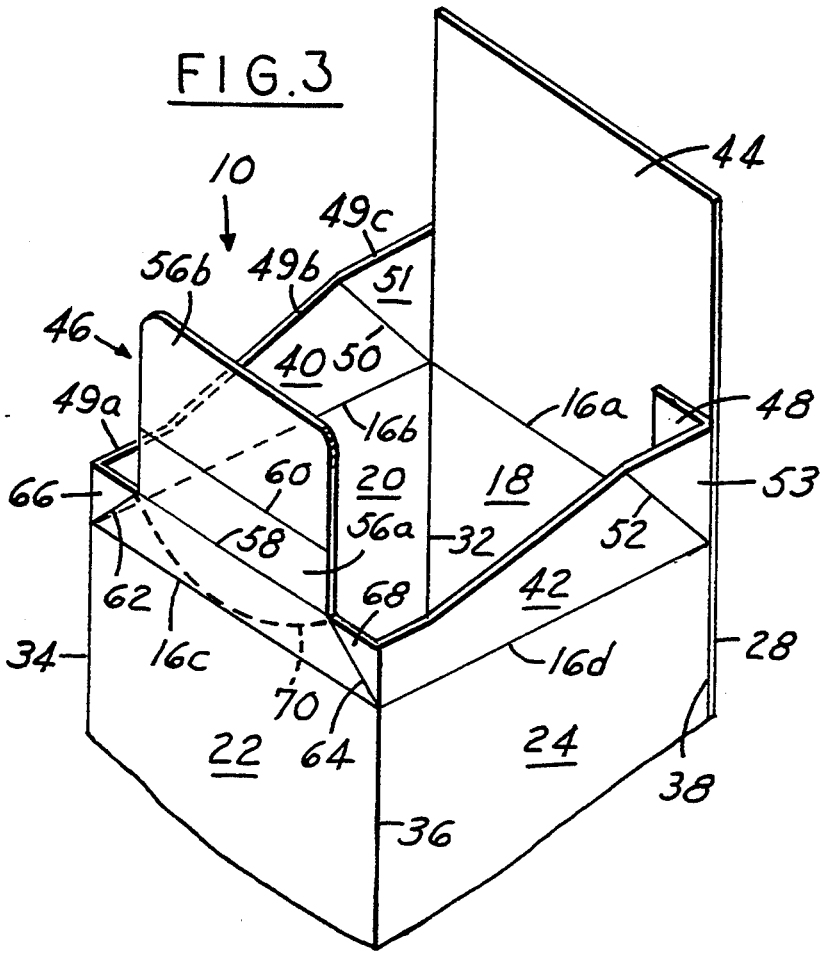
FIGS. 3 and 4 are enlarged fragmentary perspective views illustrating the initial not folded and final completely folded and sealed steps involved in forming the flat top end closure.

Accordingly, after the side seam blank is opened up into a squared condition shown in FIG. 3, the various parts of the eventual top end closure 12 are folded on the various score lines in the following manner so as to form the top end structure. The front edge panel 46 is folded or bent inwardly on the score line 16c and outwardly about the weakened or perforated line 58, resulting in the fold-out panel portion 56a engaging the fold-in panel segment 54, and causing the fold-over panel portion 56b to project outwardly. Such action will have caused the panel segment to begin to bend along the diagonal score lines 62 and 64. The side edge panels 40 and 42 are next folded or bent inwardly toward each other, causing the panel portions 66 and 68 to be pressed downwardly into engagement with the panel segment 54, while bending along the respective diagonal score lines 50 and 52. Finally, the cover panel 44 is folded or bent inwardly and downwardly, causing the panel portions 52 and 53 to be pressed downwardly into engagement with the respective panels 40 and 42 (FIG. 4).

Figure 4:
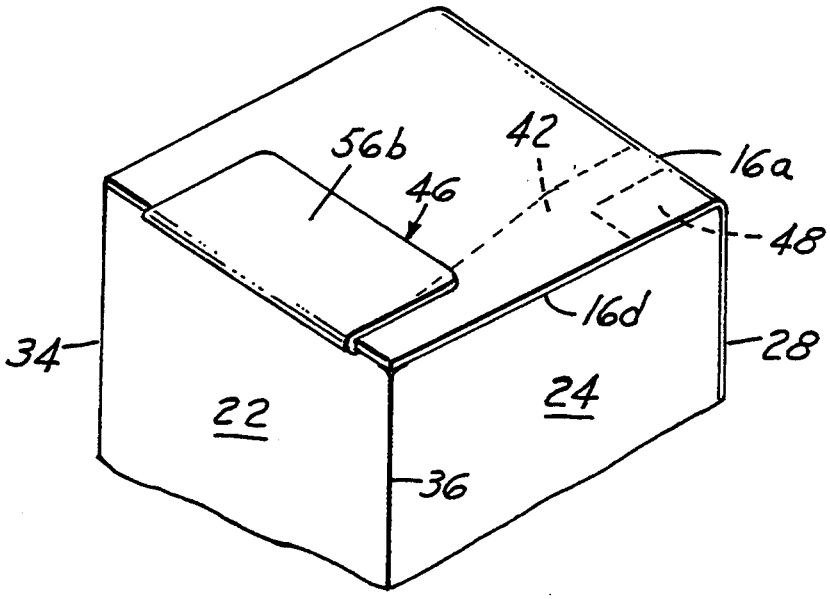

As indicated in FIG. 4, once closed, the extra width of the side edge panel 42 adjacent the cover panel 44 completely covers the edge of the panel segment 48, thereby preventing any "wicking" of contents, such as juices, into the raw edge of the panel segment 48.

The sealing of the interrelated elements of the top closure 12 is then accomplished by conventional means, such as a sonic or high frequency vibration sealing means. The fold-over panel portion 56b is then rotated to contact the outside of the cover panel 44 or, if preferred, the top edge portion of the front panel 22, and sealed thereto. The sealing of the various top end closure elements may also be accomplished by other means, such as gas heat, if desired. FIG. 4 illustrates the top end closure 12 structure once the sealing thereof has been effected. While the cover panel 44 is tightly sealed adjacent the upper ends of the body panels 20, 22 and 24 for a width equivalent to the heights of the panels 40, 42 and 54, the lift tab 56b may be merely spot welded to the cover panel 44 or the front panel 22 for easy release therefrom.

In opening the carton, the lift tab formed by the panel portion 56b is lifted from the cover panel 44 or front panel 22 and torn back, pulling the panel portion 56a away from the panel segment 54 and breaking the arcuate weakened line 70. As the lift tab 56b is raised further, the cover panel 44 is pulled away from the side edge panels 40 and 42. Simultaneously, the four fold-down panels 51, 53, 66 and 68 are partially peeled away from the panels 40, 42 and 54, thus providing an open top for pouring the liquid contents over the arcuate edge 70.

The wider fold-over panel segments 51 and 53 serve to efficiently control film delamination as the top cover 44 is torn back, and minimize panel segment 48 seepage prior to opening the top closure. The latter is accomplished by virtue of the top edge of the panel segment being sealed between the cover panel 44 and the triangular panel segment 53.

Figure 5:
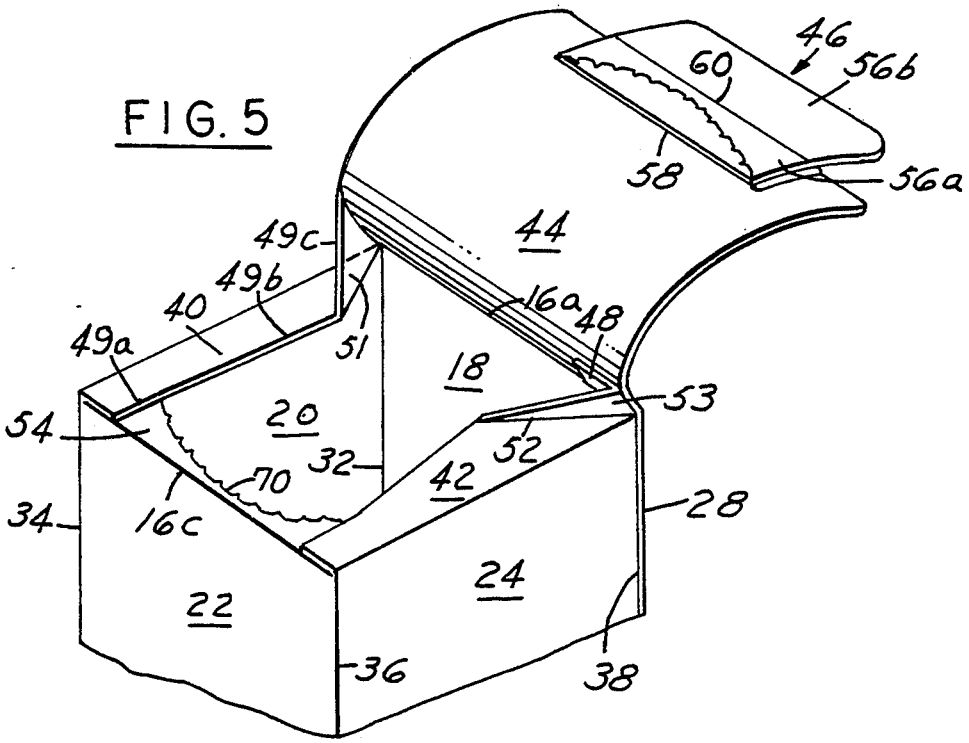
FIG. 5 is a fragmentary perspective view showing the container of FIG. 4 after the top closure has been sealed closed and then opened.

In opening the sealed cover panel 44, there is a tendency for a delamination web to start at either one of the narrow widths 49a and 49d of the side fold-in edge panels 40 and 42 adjacent the front panel 22 and to widen as the cover panel 44 is peeled back (FIG. 5). With the present embodiment, the path of the delamination will tend to follow the progressively widening edge 49b or 49e to the wider width 49c or 49f adjacent the cover panel 44. This discloses a clean open separation as opposed to one obscured by a thin web.

Figure 6:
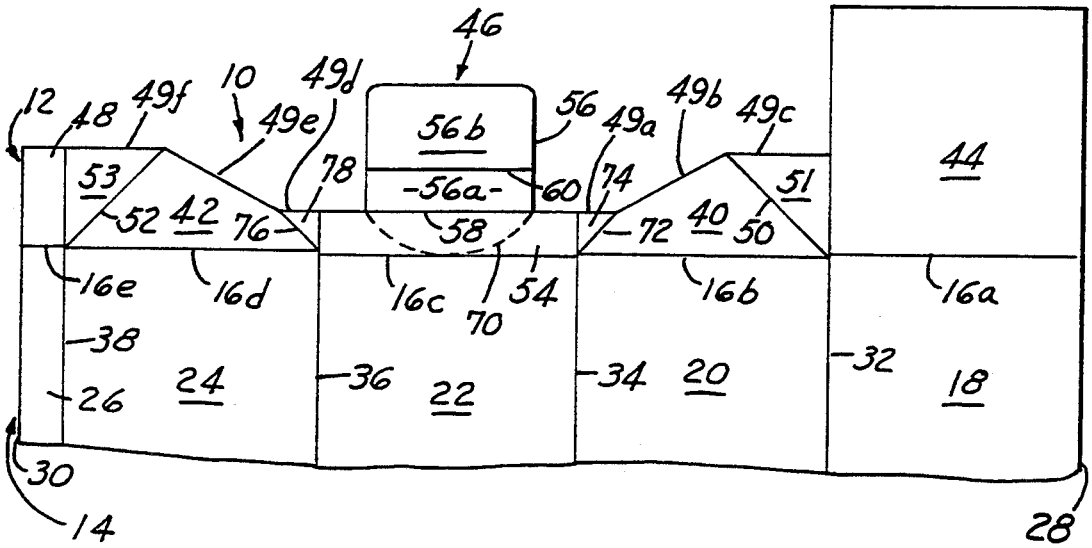
FIGS. 6 and 7 are fragmentary layout views of the inside surfaces of alternate embodiment blanks from which containers embodying the invention may be erected.

Referring now to FIG. 6, there is illustrated an alternate blank embodiment, wherein all elements which are the same as those in the FIG. 1 embodiment bear the same reference numerals. However, a diagonal score line 72 is formed from the approximate juncture of the score lines 16*b* and 34 to the juncture of the free edges 49*a* and 49*b* of the side fold-in edge panel 40 and the panel 74, forming a substantially triangular folddown panel 74 in conjunction with the panel 40, in lieu of the diagonal score line 62 and fold-down panel 66 (FIG. 1) in conjunction with the panel portion 54. Likewise, a diagonal score line 76 is formed from the approximate juncture of the score lines 16*d* and 36 to the approximate juncture of the free edges 49*d* and 49*e* of the side fold-in edge panel 42, and the panel 78, respectively, forming a substantially triangular folddown panel 78 in conjunction with the panel 42, in lieu of the diagonal score line 64 and fold-down panel 68 (FIG. 1) in conjunction with the panel portion 54. In the forming of this arrangement, the side edge panels would be folded or bent inwardly first, followed by the folding or bending of the panel portions 54, 56*a* and 56*b*. The fold-down panels 74 and 78 are thus pressed into engagement with, and sealed to, the panels 40 and 42, respectively, beneath the cover panel 44.

Figure 7:
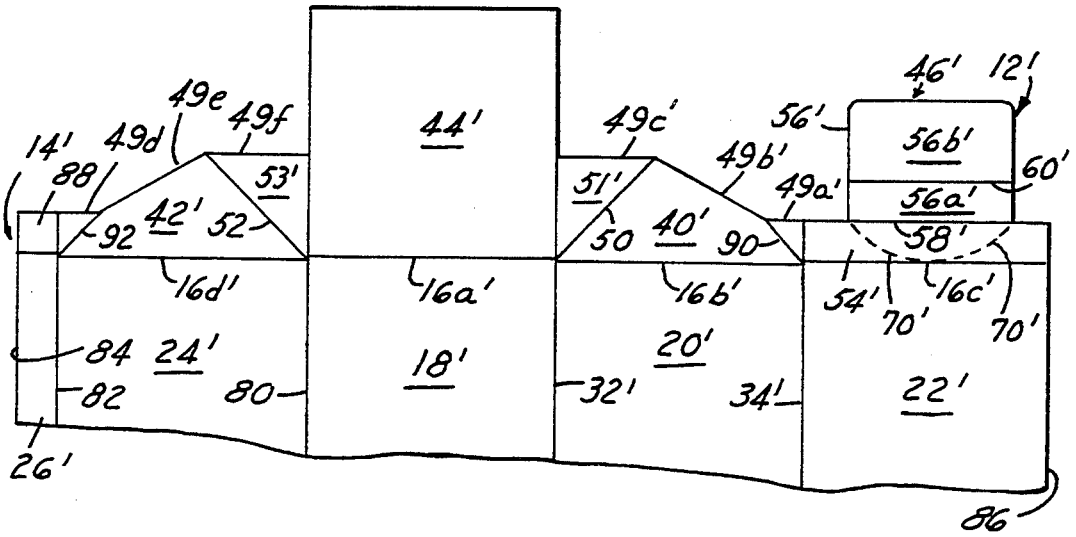

Referring now to FIG. 7, there is illustrated still another alternate blank embodiment, wherein all elements which are the same as those in the FIG. 1 embodiment bear the same reference numerals as in FIG. 1, but with primes attached thereto. However, the various longitudinally oriented panels are rearranged with respect to the panels on either side thereof.

Specifically, the side panel 24' is integrally connected between the rear panel 18' and the side seam flap 26', by vertical score lines 80 and 82, respectively, such that in FIG. 7, from left to right, the panels are the side seam flap 26', side panel 24', rear panel 18', side panel 20', and front panel 22'. The edges are defined as 84 on the side seam flap 26', and as 86 on the front panel 22'. An extension of the side seam flap 26' is a panel segment 88 adjacent the top closure panel 42'. Diagonal score lines 90 and 92 are similar to the diagonal score lines 72 and 76, respectively, of the FIG. 6 structure, i.e., formed on the top panels 40' and 42', rather than being formed on the fold-in panel segment 54'.

INDUSTRIAL APPLICABILITY

It should be apparent that the invention provides an improved thermoplastic coated paperboard carton wherein an efficient, arcuate-shaped pouring edge is provided when the carton is opened.

It should be further apparent that film delamination is effectively controlled when the top closure is being opened and that seepage or wicking around the upper end of the side seam is prevented, by virtue of the wider rear portion of side edge panels.

It should be still further apparent that, by virtue of the wider rear portion of the side seam panels, and their integral connection to the cover panel, there is a tendency for the side seams to be lifted into a more open configuration, enhancing the use of the carton for spoonable products.

While three embodiments of the invention have been shown and described, other modifications thereof are possible within the scope of the following claims.

What is claimed is:

1. A thermoplastics coated blank for forming into a container, wherein the blank includes:

(a) a row of first, second, third and fourth body panels, (b) a side seam flap extending from one of said first and fourth body panels at one end of said row for sealing to the other of said first and fourth body panels at the opposite end of said row, (c) a row of first, second, third and fourth fold-in closure panels parallel to and extending along the row of body panels, the closure panels being connected to respective ends of the respective body panels, one of said closure panels being a cover panel, and (d) an extension panel extending from one of said first and fourth closure panels at one end of the row of closure panels and connected to an adjacent end of said side seam flap and to an edge of said one of said first and fourth closure panels for being sealed to the other of said first and fourth closure panels and for subsequently being sealed between said one and said other of said first and fourth closure panels with said first closure panel overlying said fourth closure panel, characterized in that said fourth closure panel includes means for preventing seepage past the outer end of said extension panel when it is sealed between said one and said other of said first and fourth closure panels, and for controlling film delamination when said cover panel is torn back after being sealed.

2. A blank according to claim 1, wherein said means for preventing seepage comprises a portion of said fourth closure panel being of a dimension perpendicular to said row of closure panels which is greater than the dimension of said outer end of said extension panel longitudinally of said row of closure panels.

3. A thermoplastics coated container, including:

(a) a tube of first, second, third and fourth body panels, (b) a side seam flap extending from one of said first and fourth body panels at one end of said tube and sealed to the other of said first and fourth body panels at the opposite end of said tube, (c) a tube of first, second, third and fourth closure panels parallel to and extending along the tube of body panels, the closure panels being connected to respective ends of the respective body panels, one of said closure panels being a cover panel, and (d) an extension panel extending from one of said first and fourth closure panels at one end of the tube of closure panels, connected to an adjacent end of said side seam flap and to an edge of said one of said first and fourth closure panels and sealed between said first and fourth closure panels with said first closure panel overlying said fourth closure panel, characterized in that said fourth closure panel includes means for preventing seepage past the inner end of said extension panel, and for controlling film delamination as said cover panel is torn back.

4. A container according to claim 3, wherein said means for preventing seepage comprises a portion of said fourth closure panel being of a dimension parallel to said inner end of said extension panel greater than said inner end of said extension panel.

5. A thermoplastics coated blank for forming into a container, wherein the blank comprises:

(a) a row of body panels including front and back body panels and a pair of side body panels, (b) side fold-in edge panels integrally connected to the upper ends of the respective side body panels for turning inwardly towards each other, (c) a front edge panel integrally connected to the upper end of the front body panel for turning inwardly towards the back body panel, and (d) a cover panel integrally connected to the upper end of the back body panel for sealing to said side fold-in-edge panels and said front edge panel and subsequently peeling away from said front edge panel and said side fold-in edge panels, characterized by said side fold-in edge panels including means for steering said peeling of said cover panel so as to deter delamination of said cover panel.

6. A blank according to claim 5, wherein said means for steering comprises-said side fold-in edge panels gradually widening progressing away from said front edge panel.

7. A thermoplastics coated container comprising:

(a) a tube of body panels including front and back body panels and a pair of side body panels, (b) side fold-in edge panels integrally connected to the upper ends of the respective side body panels and extending inwardly towards each other, (c) a front edge panel integrally connected to the upper end of the front body panel and extending inwardly towards the back body panel, and (d) a cover panel integrally connected to the upper end of the back body panel and sealed to said side fold-in edge panels and said front edge panel for subsequently peeling away from said front edge panel and said side fold-in edge panels, characterized by said side fold-in edge panels including means for steering said peeling of said cover panel so as to deter delamination of said cover panel.

8. A blank according to claim 7, wherein said means for steering comprises respective innermost edge portions of said side fold-in edge panels gradually converging towards each other progressing away from said front edge panel.

* * * * *